US008887465B2

(12) United States Patent
Crosby et al.

(10) Patent No.: US 8,887,465 B2
(45) Date of Patent: Nov. 18, 2014

(54) APPARATUS AND METHOD FOR CONSTRUCTION OF STRUCTURES UTILIZING INSULATED CONCRETE FORMS

(71) Applicant: Airlite Plastics Co., Omaha, NE (US)

(72) Inventors: Bradley J. Crosby, Omaha, NE (US); Patrick D. Gredys, Omaha, NE (US); Glen Klassen, Winnipeg (CA)

(73) Assignee: Airlite Plastics Co., Omaha, NE (US)

( * ) Notice: Subject to any disclaimer, the term of this patent is extended or adjusted under 35 U.S.C. 154(b) by 0 days.

(21) Appl. No.: 13/739,624

(22) Filed: Jan. 11, 2013

(65) Prior Publication Data

US 2013/0180192 A1 Jul. 18, 2013

Related U.S. Application Data

(60) Provisional application No. 61/586,533, filed on Jan. 13, 2012.

(51) Int. Cl.
*E04B 2/32* (2006.01)
*E04B 2/86* (2006.01)

(52) U.S. Cl.
CPC ..... *E04B 2/8635* (2013.01)
USPC ..... 52/405.4; 52/379; 52/426; 52/428; 52/565; 52/699; 52/742.14; 52/745.1

(58) Field of Classification Search
CPC ..... E04B 2/32; E04B 2/8617; E04B 2/8635; E04C 2002/045; E04C 2002/046
USPC ..... 52/251, 259, 309.11, 309.12, 379, 52/404.2, 404.3, 404.5, 405.1–405.4, 52/407.3, 426, 428, 442, 562–565, 699, 52/714, 742.14, 745.1, 745.12, 745.13; 249/8, 214, 208
See application file for complete search history.

(56) References Cited

U.S. PATENT DOCUMENTS 221,110 A 10/1879 Shellenback et al.
1,694,665 A 12/1928 Parker (Continued)

FOREIGN PATENT DOCUMENTS

AU 664029 9/1992
CA 2492969 8/2005

(Continued)

OTHER PUBLICATIONS

Portland Cement Association, Prescriptive Design of Exterior Concrete Walls for One- and Two-Family Dwellings (2008), 123 pages.
NAHB Research Center, Inc., Prescriptive Method for Insulating Concrete Forms in Residential Construction (2008), 100 pages.
NAHB Research Center, Inc., Prescriptive Method for Insulating Concrete Forms in Residential Construction (2d ed. 2002), 62 pages.

(Continued)

*Primary Examiner* — Mark Wendell
*Assistant Examiner* — Matthew J Smith
(74) *Attorney, Agent, or Firm* — Banner & Witcoff, Ltd.

(57) ABSTRACT

An insulated concrete form having spaced sidewalls joined by form ties to define a first interior cavity therebetween for receiving poured concrete, the form ties including interior fastening plates positioned in between the spaced sidewalls. The interior fastening plates provide a backing surface to which forming structures can be easily and efficiently secured to define a second interior cavity in between the forming structure and one of the sidewalls, the second interior cavity having thickness less than the first interior cavity so as to define a form for making a recess in the resulting concrete portion of the wall.

13 Claims, 11 Drawing Sheets

(56) References Cited

U.S. PATENT DOCUMENTS

| | | | |
|---|---|---|---|
| 1,796,973 | A | 3/1931 | Wright |
| 1,836,408 | A | 12/1931 | Sutton |
| 1,895,801 | A | 1/1933 | Keller |
| 1,983,040 | A | 12/1934 | Lyons |
| 2,073,788 | A | 3/1937 | Garvey et al. |
| 2,177,246 | A | 10/1939 | Ellis |
| 2,201,110 | A | 5/1940 | Makram |
| 2,452,463 | A | 10/1948 | Herbert |
| 2,498,276 | A | 2/1950 | Kany |
| 3,255,562 | A | 6/1966 | Altschuler |
| 3,374,917 | A | 3/1968 | Troy |
| 3,383,817 | A | 5/1968 | Gregori |
| 3,422,588 | A | 1/1969 | Stewart, Jr. |
| 3,552,076 | A | 1/1971 | Gregori |
| 3,740,909 | A | 6/1973 | Stinnes |
| 3,788,020 | A | 1/1974 | Gregori |
| 3,791,090 | A | 2/1974 | Kniefel |
| 3,895,469 | A | 7/1975 | Kapitan |
| 3,924,376 | A | 12/1975 | Tsurumi |
| 3,936,987 | A | 2/1976 | Calvin |
| 3,959,944 | A | 6/1976 | Oroschakoff |
| 3,968,615 | A | 7/1976 | Ivany |
| 3,992,844 | A | 11/1976 | Gretter |
| 4,021,989 | A | 5/1977 | Hala |
| 4,022,644 | A | 5/1977 | Smith, Jr. |
| 4,031,678 | A | 6/1977 | Schuring |
| 4,034,529 | A | 7/1977 | Lampus |
| 4,041,670 | A | 8/1977 | Kaplan |
| 4,060,952 | A | 12/1977 | Hernandez |
| 4,090,337 | A | 5/1978 | Szekeres |
| 4,107,895 | A | 8/1978 | LeGrady |
| 4,133,156 | A | 1/1979 | Unger |
| 4,185,423 | A | 1/1980 | Gutierrez |
| 4,223,501 | A | 9/1980 | DeLozier |
| 4,226,061 | A | 10/1980 | Day, Jr. |
| 4,229,920 | A | 10/1980 | Lount |
| 4,240,233 | A | 12/1980 | Vercelletto |
| 4,263,765 | A | 4/1981 | Maloney |
| 4,321,779 | A | 3/1982 | Kratchmer |
| 4,348,847 | A | 9/1982 | Jukes |
| 4,366,657 | A | 1/1983 | Hopman |
| 4,402,167 | A | 9/1983 | Denucci |
| 4,406,103 | A | 9/1983 | Ghali et al. |
| 4,407,102 | A | 10/1983 | Boyack |
| 4,411,118 | A | 10/1983 | Claver |
| 4,433,520 | A | 2/1984 | Maschhoff |
| 4,433,521 | A | 2/1984 | Dietrich |
| 4,433,522 | A | 2/1984 | Yerushalmi |
| 4,438,612 | A | 3/1984 | Bernard et al. |
| 4,439,967 | A | 4/1984 | Dielenberg |
| 4,442,644 | A | 4/1984 | Jukes |
| 4,471,590 | A | 9/1984 | Roberts et al. |
| 4,479,338 | A | 10/1984 | Robertson |
| 4,516,372 | A | 5/1985 | Grutsch |
| 4,551,870 | A | 11/1985 | Presti, Jr. |
| 4,557,093 | A | 12/1985 | Beliveau |
| 4,557,094 | A | 12/1985 | Beliveau |
| 4,571,909 | A | 2/1986 | Berghuis et al. |
| 4,577,447 | A | 3/1986 | Doran |
| 4,598,519 | A | 7/1986 | Reid |
| 4,599,830 | A | 7/1986 | Nawrot |
| 4,604,843 | A | 8/1986 | Ott et al. |
| 4,628,652 | A | 12/1986 | Wefels |
| 4,629,192 | A | 12/1986 | Nichols |
| 4,632,796 | A | 12/1986 | Moulet |
| 4,648,228 | A | 3/1987 | Kiselewski |
| 4,655,014 | A | 4/1987 | Krecke |
| 4,698,947 | A | 10/1987 | McKay |
| 4,700,523 | A | 10/1987 | Kohara |
| 4,706,429 | A | 11/1987 | Young |
| 4,730,422 | A | 3/1988 | Young |
| 4,731,968 | A | 3/1988 | Obino |
| 4,742,659 | A | 5/1988 | Meilleur |
| 4,750,307 | A | 6/1988 | Slager |
| 4,750,308 | A | 6/1988 | McKay |
| 4,765,109 | A | 8/1988 | Boeshart |
| 4,773,199 | A | 9/1988 | Kohara |
| 4,788,020 | A | 11/1988 | Yampolsky et al. |
| 4,791,767 | A | 12/1988 | Boeshart |
| 4,811,927 | A | 3/1989 | Slonimsky et al. |
| 4,817,353 | A | 4/1989 | Woods et al. |
| 4,825,618 | A | 5/1989 | Blevins |
| 4,835,928 | A | 6/1989 | Scott |
| 4,852,317 | A | 8/1989 | Schiavello et al. |
| 4,860,515 | A | 8/1989 | Browning, Jr. |
| 4,862,660 | A | 9/1989 | Raymond |
| 4,864,792 | A | 9/1989 | Andre et al. |
| 4,866,891 | A | 9/1989 | Young |
| 4,879,855 | A | 11/1989 | Berrenberg |
| 4,883,396 | A | 11/1989 | Shamah et al. |
| 4,884,382 | A | 12/1989 | Horobin |
| 4,885,888 | A | 12/1989 | Young |
| 4,888,931 | A | 12/1989 | Meilleur |
| 4,889,310 | A | 12/1989 | Boeshart |
| 4,894,969 | A | 1/1990 | Horobin |
| 4,901,494 | A | 2/1990 | Miller et al. |
| 4,916,879 | A | 4/1990 | Boeshart |
| 4,936,540 | A | 6/1990 | Boeshart |
| 4,938,449 | A | 7/1990 | Boeshart |
| 4,949,515 | A | 8/1990 | Krecke |
| 4,967,528 | A | 11/1990 | Doran |
| 4,972,646 | A | 11/1990 | Miller et al. |
| 4,974,388 | A | 12/1990 | Fischer |
| 4,976,081 | A | 12/1990 | Litzenberger |
| 4,998,394 | A | 3/1991 | Holzapfel et al. |
| 5,014,480 | A | 5/1991 | Guarriello et al. |
| 5,024,035 | A | 6/1991 | Hanson et al. |
| 5,060,446 | A | 10/1991 | Beliveau |
| 5,065,561 | A | 11/1991 | Mason |
| 5,086,600 | A | 2/1992 | Holland et al. |
| 5,092,093 | A | 3/1992 | Lu |
| 5,097,644 | A | 3/1992 | Hun |
| 5,099,628 | A | 3/1992 | Noland et al. |
| 5,099,630 | A | 3/1992 | Bolmgren |
| 5,107,648 | A | 4/1992 | Roby |
| 5,117,600 | A | 6/1992 | Yerushalmi |
| 5,122,015 | A | 6/1992 | Shen |
| 5,123,222 | A | 6/1992 | Guarriello et al. |
| 5,140,794 | A | 8/1992 | Miller |
| 5,163,261 | A | 11/1992 | O'Neill |
| 5,174,083 | A | 12/1992 | Mussell |
| D335,542 | S | 5/1993 | Bird |
| 5,212,842 | A | 5/1993 | Glydon |
| 5,215,490 | A | 6/1993 | Szoradi |
| D343,426 | S | 1/1994 | Sher |
| D343,427 | S | 1/1994 | Sher |
| 5,323,578 | A | 6/1994 | Chagnon et al. |
| 5,337,530 | A | 8/1994 | Beames |
| 5,350,256 | A | 9/1994 | Hammer |
| 5,351,455 | A | 10/1994 | Schoonover et al. |
| 5,351,456 | A | 10/1994 | Paine, Jr. |
| 5,390,459 | A | 2/1995 | Mensen |
| 5,428,933 | A | 7/1995 | Philippe |
| 5,454,199 | A | 10/1995 | Blom et al. |
| 5,459,970 | A | 10/1995 | Kim |
| 5,459,971 | A | 10/1995 | Sparkman |
| 5,465,542 | A | 11/1995 | Terry |
| 5,473,850 | A | 12/1995 | Balding |
| 5,491,949 | A | 2/1996 | De Moor |
| D370,503 | S | 6/1996 | Burns |
| 5,535,565 | A | 7/1996 | Majnaric et al. |
| 5,537,797 | A | 7/1996 | Harkenrider et al. |
| 5,553,430 | A | 9/1996 | Majnaric et al. |
| 5,566,518 | A | 10/1996 | Martin et al. |
| 5,566,519 | A | 10/1996 | Almaraz-Miera |
| 5,566,521 | A | 10/1996 | Andrews et al. |
| 5,568,710 | A | 10/1996 | Smith et al. |
| 5,570,552 | A | 11/1996 | Nehring |
| 5,596,855 | A | 1/1997 | Batch |
| 5,598,675 | A | 2/1997 | Pruss |
| 5,608,999 | A | 3/1997 | McNamara |
| 5,611,182 | A | 3/1997 | Spude |
| 5,611,183 | A | 3/1997 | Kim |
| 5,617,693 | A | 4/1997 | Hefner |

(56) References Cited

U.S. PATENT DOCUMENTS

| | | | |
|---|---|---|---|
| 5,625,989 | A | 5/1997 | Brubaker et al. |
| 5,632,126 | A | 5/1997 | Agsten |
| 5,638,652 | A | 6/1997 | Shinoda et al. |
| 5,649,401 | A | 7/1997 | Harrington, Jr. |
| 5,653,082 | A | 8/1997 | Shinoda et al. |
| 5,657,600 | A | 8/1997 | Mensen |
| 5,657,601 | A | 8/1997 | Bean et al. |
| 5,658,483 | A | 8/1997 | Boeshart |
| 5,678,369 | A | 10/1997 | Ishikawa et al. |
| 5,688,078 | A | 11/1997 | Hammer |
| 5,692,356 | A | 12/1997 | Baxter |
| 5,695,676 | A | 12/1997 | Lee |
| 5,699,640 | A | 12/1997 | Bourgeois et al. |
| 5,701,710 | A | 12/1997 | Tremelling |
| 5,704,180 | A | 1/1998 | Boeck |
| 5,709,060 | A | 1/1998 | Vaughan et al. |
| 5,709,061 | A | 1/1998 | Dietrich |
| 5,735,093 | A | 4/1998 | Grutsch |
| 5,740,648 | A | 4/1998 | Piccone |
| 5,768,851 | A | 6/1998 | Nagaoka |
| 5,782,050 | A | 7/1998 | Boeshart |
| 5,802,793 | A | 9/1998 | DeVore, Jr. |
| 5,802,795 | A | 9/1998 | Myers et al. |
| 5,803,669 | A | 9/1998 | Bullard |
| 5,809,723 | A | 9/1998 | Keith et al. |
| 5,809,725 | A | 9/1998 | Cretti |
| 5,809,726 | A | 9/1998 | Spude |
| 5,809,727 | A | 9/1998 | Mensen |
| 5,809,728 | A | 9/1998 | Tremelling |
| 5,818,997 | A | 10/1998 | Fasanella et al. |
| 5,819,489 | A | 10/1998 | McKinney |
| 5,836,126 | A | 11/1998 | Harkenrider et al. |
| 5,839,243 | A | 11/1998 | Martin |
| 5,845,445 | A | 12/1998 | Blackbeard |
| 5,845,449 | A | 12/1998 | Vaughan et al. |
| 5,845,455 | A | 12/1998 | Johnson, III |
| 5,852,907 | A | 12/1998 | Tobin et al. |
| 5,853,314 | A | 12/1998 | Bora |
| 5,857,300 | A | 1/1999 | Gates |
| 5,860,262 | A | 1/1999 | Johnson |
| 5,881,524 | A | 3/1999 | Ellison, Jr. |
| 5,887,401 | A | 3/1999 | Moore, Jr. |
| 5,890,337 | A | 4/1999 | Boeshart |
| 5,893,248 | A | 4/1999 | Beliveau |
| 5,895,188 | A | 4/1999 | Cheng |
| 5,896,714 | A | 4/1999 | Cymbala et al. |
| 5,918,427 | A | 7/1999 | VanderWerf |
| 5,930,958 | A | 8/1999 | Stanley |
| 5,930,970 | A | 8/1999 | De Le fevre |
| 5,937,604 | A | 8/1999 | Bowron |
| 5,945,448 | A | 8/1999 | Ninomiya et al. |
| 5,987,830 | A | 11/1999 | Worley |
| 5,992,114 | A | 11/1999 | Zelinsky et al. |
| 6,000,184 | A | 12/1999 | Fernandes |
| 6,070,380 | A | 6/2000 | Meilleur |
| 6,085,476 | A | 7/2000 | Jantzi et al. |
| 6,112,491 | A | 9/2000 | Keith et al. |
| 6,122,880 | A | 9/2000 | Kolb et al. |
| 6,131,360 | A | 10/2000 | Dalen |
| 6,148,576 | A | 11/2000 | Janopaul, Jr. |
| 6,151,856 | A | 11/2000 | Shimonohara |
| 6,167,671 | B1 | 1/2001 | Wilson |
| 6,170,220 | B1 | 1/2001 | Moore, Jr. |
| 6,173,937 | B1 | 1/2001 | Cottongim |
| 6,176,059 | B1 | 1/2001 | Cantarano et al. |
| 6,219,984 | B1 | 4/2001 | Piccone |
| 6,224,031 | B1 | 5/2001 | Boeshart |
| 6,226,951 | B1 | 5/2001 | Azar |
| 6,230,462 | B1 | 5/2001 | Beliveau |
| 6,231,024 | B1 | 5/2001 | Kugimiya et al. |
| 6,231,025 | B1 | 5/2001 | Takemura |
| 6,233,897 | B1 | 5/2001 | Jurik |
| 6,240,692 | B1 | 6/2001 | Yost et al. |
| 6,250,024 | B1 | 6/2001 | Sculthorpe et al. |
| 6,250,033 | B1 | 6/2001 | Zelinsky |
| 6,252,523 | B1 | 6/2001 | Mostrom |
| 6,253,518 | B1 | 7/2001 | Azar |
| 6,253,519 | B1 | 7/2001 | Daniel |
| 6,253,523 | B1 | 7/2001 | McKinnon |
| 6,263,631 | B1 | 7/2001 | Nisbett et al. |
| 6,276,104 | B1 | 8/2001 | Long, Sr. et al. |
| 6,276,549 | B1 | 8/2001 | Fasci et al. |
| 6,279,285 | B1 | 8/2001 | Kubica |
| 6,279,287 | B1 | 8/2001 | Meadows |
| 6,293,059 | B1 | 9/2001 | Goodwin |
| 6,293,067 | B1 | 9/2001 | Meendering |
| 6,293,068 | B1 | 9/2001 | Harrington, Jr. |
| 6,301,851 | B1 | 10/2001 | Matsubara |
| 6,308,484 | B1 | 10/2001 | Severino |
| 6,314,694 | B1 | 11/2001 | Cooper et al. |
| 6,314,697 | B1 | 11/2001 | Moore, Jr. |
| 6,318,040 | B1 | 11/2001 | Moore, Jr. |
| 6,321,496 | B1 | 11/2001 | Martin, Jr. |
| 6,321,497 | B1 | 11/2001 | Cormier |
| 6,321,498 | B1 | 11/2001 | Trovato |
| 6,324,804 | B1 | 12/2001 | Hoogstraten |
| 6,332,300 | B1 | 12/2001 | Wakai |
| 6,336,301 | B1 | 1/2002 | Moore, Jr. |
| 6,349,520 | B2 | 2/2002 | Kubica |
| 6,352,237 | B1 | 3/2002 | Severino |
| 6,360,505 | B1 | 3/2002 | Johns |
| 6,363,683 | B1 | 4/2002 | Moore, Jr. |
| 6,378,260 | B1 | 4/2002 | Williamson et al. |
| 6,378,261 | B1 | 4/2002 | Agsten |
| 6,401,413 | B1 | 6/2002 | Niemann |
| 6,401,419 | B1 | 6/2002 | Beliveau |
| 6,412,231 | B1 | 7/2002 | Palatin |
| 6,438,917 | B2 | 8/2002 | Kubica |
| 6,438,918 | B2 | 8/2002 | Moore, Jr. et al. |
| 6,474,033 | B1 | 11/2002 | Luchini et al. |
| 6,481,178 | B2 | 11/2002 | Moore, Jr. |
| 6,519,906 | B2 | 2/2003 | Yost et al. |
| 6,526,713 | B2 | 3/2003 | Moore, Jr. |
| 6,536,172 | B1 | 3/2003 | Amend |
| 6,568,141 | B2 | 5/2003 | Kremers |
| 6,574,934 | B1 | 6/2003 | Queirel |
| 6,578,333 | B1 | 6/2003 | Gagliano |
| 6,609,340 | B2 | 8/2003 | Moore, Jr. et al. |
| 6,647,686 | B2 | 11/2003 | Dunn et al. |
| 6,665,992 | B2 | 12/2003 | Hew |
| 6,668,502 | B2 | 12/2003 | Beliveau |
| 6,668,503 | B2 | 12/2003 | Beliveau |
| 6,681,539 | B2 | 1/2004 | Yost et al. |
| 6,688,066 | B1 | 2/2004 | Cottier et al. |
| 6,691,481 | B2 | 2/2004 | Schmidt |
| 6,761,007 | B2 | 7/2004 | Lancelot, III et al. |
| 6,792,729 | B2 | 9/2004 | Beliveau |
| 6,820,384 | B1 | 11/2004 | Pfeiffer |
| 6,886,303 | B2 * | 5/2005 | Schmidt ..... 52/426 |
| 6,978,581 | B1 * | 12/2005 | Spakousky ..... 52/405.4 |
| 7,059,577 | B1 | 6/2006 | Burgett |
| 7,082,731 | B2 | 8/2006 | Patz et al. |
| 2005/0204679 | A1 | 9/2005 | Pfeiffer |
| 2005/0223669 | A1 | 10/2005 | Cymbala et al. |
| 2006/0117693 | A1 | 6/2006 | Garrett |
| 2006/0213140 | A1 | 9/2006 | Morin et al. |

FOREIGN PATENT DOCUMENTS

| | | |
|---|---|---|
| CN | 2291457 | 9/1998 |
| CN | 1230237 | 9/1999 |
| DE | 4415406 | 11/1995 |
| GB | 190013282 | 0/1901 |
| GB | 488640 | 7/1938 |
| WO | 9512720 | 5/1995 |

OTHER PUBLICATIONS

Pieter A. VanderWerf et al., Insulating Concrete Forms (McGraw-Hill 1997).

* cited by examiner

APPARATUS AND METHOD FOR CONSTRUCTION OF STRUCTURES UTILIZING INSULATED CONCRETE FORMS

FIELD OF THE INVENTION

This application claims priority from U.S. Provisional Application No. 61/586,533, entitled, "An Apparatus and Method for Construction of Structures Utilizing Insulated Concrete Forms," filed on Jan. 13, 2012 and which is herein incorporated by reference in its entirety.

BACKGROUND OF THE INVENTION

Insulated concrete forms (ICFs) of variable design comprise an increasingly important and popular product for construction of buildings and other structures. Such ICF products typically include a pair of spaced sidewalls fabricated from an insulating material. The paired sidewalls are maintained in a spaced relationship by connecting form ties. The form ties may be configured to support reinforcing bars (rebar). The ICF products are typically modular sizes and designed to be stacked to provide a form adapted to receive poured concrete in the cavity between the sidewalls, thereby resulting in a poured concrete structure intermediate sidewalls of an insulating material. An example of ICF products are depicted in U.S. Pat. No. 7,861,479, which is incorporated by reference as if fully set forth herein.

BRIEF DESCRIPTION OF THE DRAWINGS

Further details, aspects, and embodiments of the invention will be described, by way of example only, with reference to the drawings.

SUMMARY OF THE INVENTION

An assembly for construction of structures utilizing insulated concrete forms includes an insulated concrete form comprising having a first sidewall with a first interior surface, a second sidewall with a second interior surface, and where a height of the first sidewall is less than a height of the second sidewall; the insulating concrete form includes a plurality of form ties, where the plurality of form ties connect the first sidewall to the second sidewall such that the first sidewall is spaced from the second sidewall to define a first interior cavity in between the first interior surface of the first sidewall and the second interior surface of the second sidewall, and where a thickness of the first interior cavity is defined in a lateral direction between the first interior surface of the first sidewall and the second interior surface of the second sidewall; the plurality of form ties include a first form tie, the first form tie has a first side member secured to the first sidewall, a second side member secured to the second sidewall, an upper lateral member, and a lower lateral member, where the upper and lower lateral members are positioned transverse the first and second side members, and where the lower lateral member connects the first side member to the second side member; an interior fastening plate is secured to the first form tie, the interior fastening plate has a first planar face, and the interior fastening plate is oriented such that the first planar face faces in a lateral direction toward the first interior surface of the first sidewall, and the interior fastening plate is spaced from the second interior surface of the second sidewall; a forming structure having an interior forming surface is secured to the interior fastening plate and oriented such that the interior forming surface of the forming structure faces toward the second interior surface of the second sidewall, and the interior forming surface is spaced from the second sidewall to define a second interior cavity in between the interior forming surface of the forming structure and the second interior surface of the second sidewall, where a thickness of the second interior cavity is defined in a lateral direction between the interior forming surface of the forming structure and the second interior surface of the second sidewall; and the thickness of the first interior cavity is greater than the thickness of the second interior cavity.

DETAILED DESCRIPTION

Figure 1:
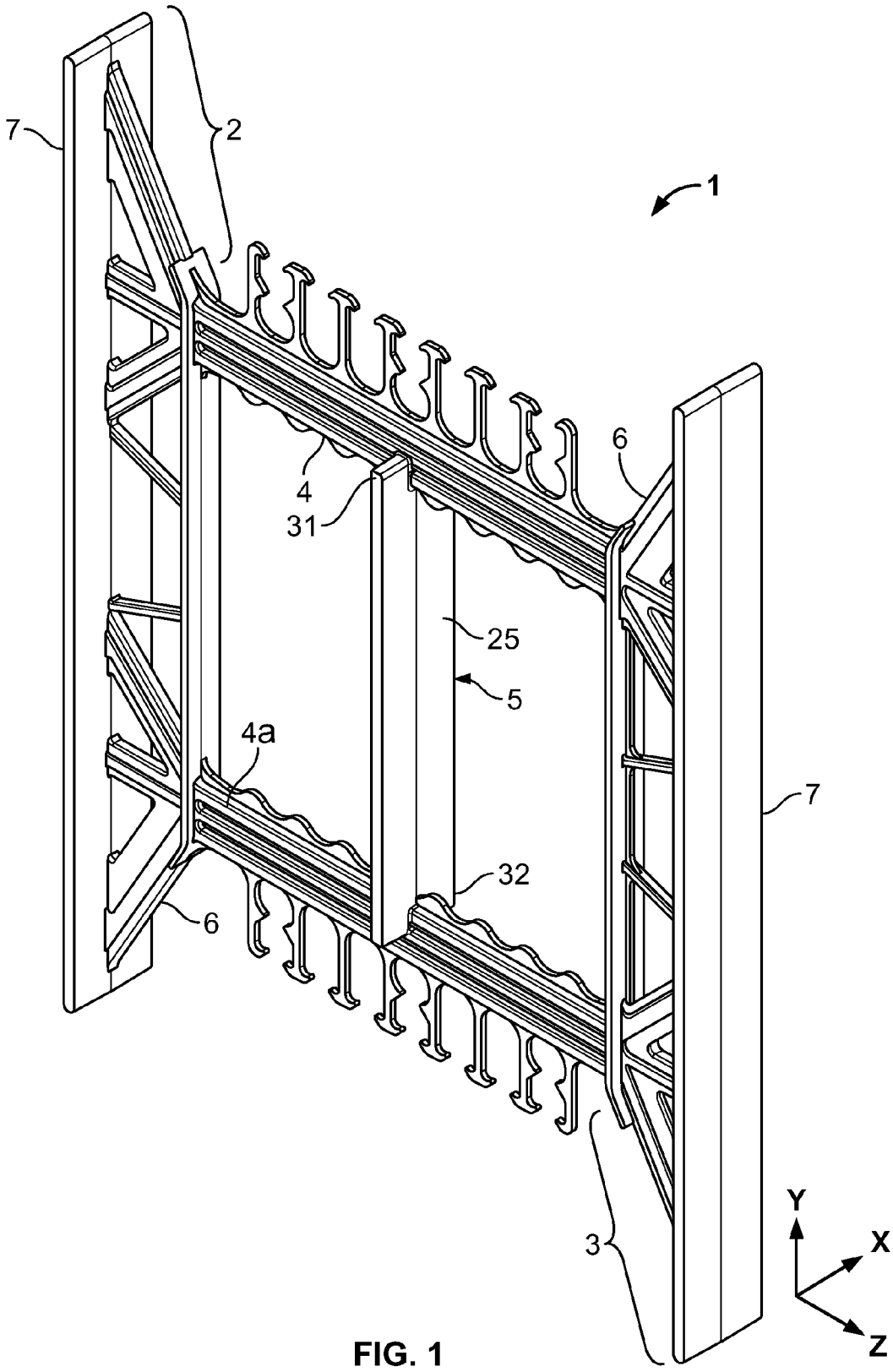
FIG. 1 is a top, right perspective view of an embodiment of a form tie having an interior fastening plate.
Figure 1A:
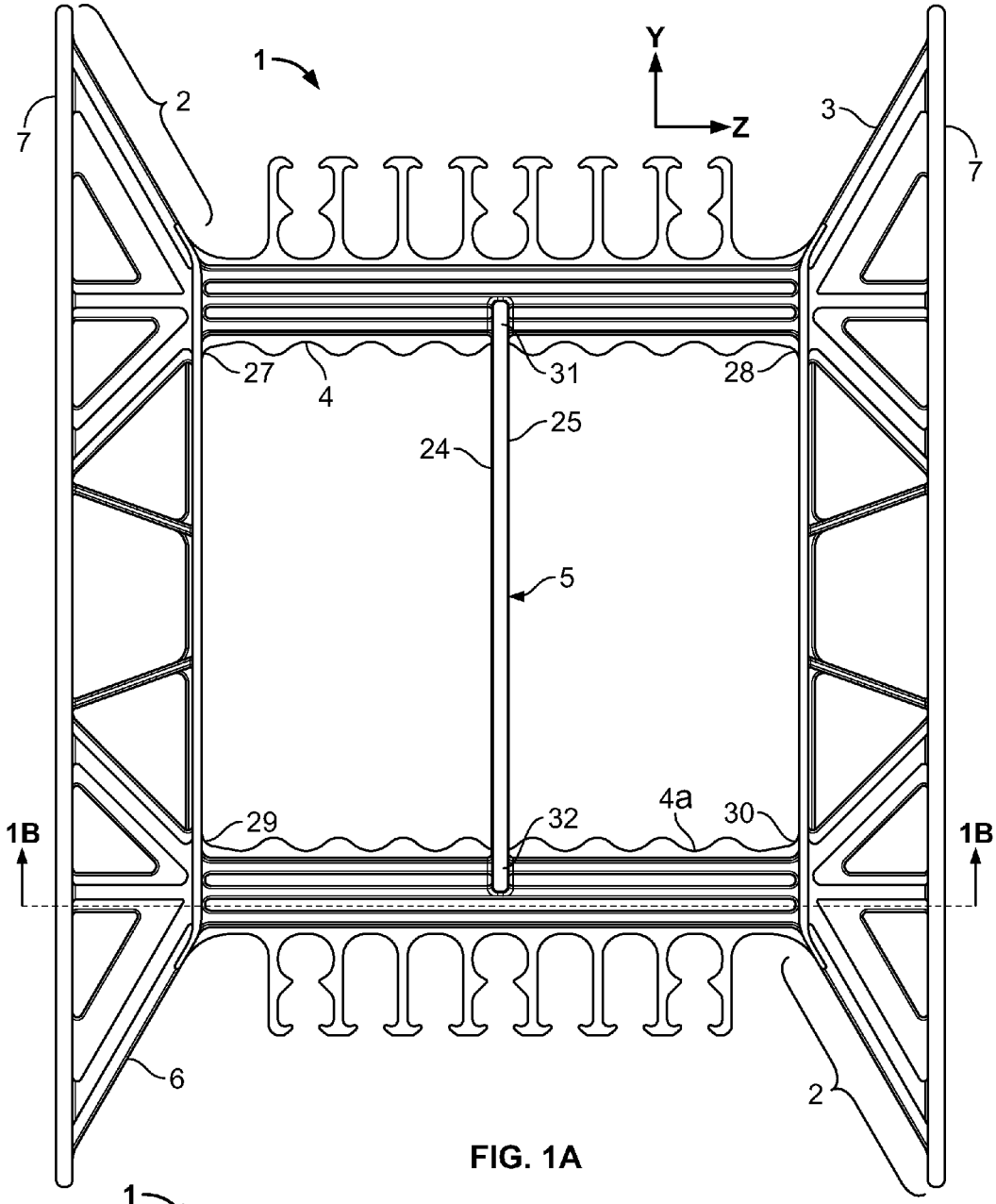
FIG. 1A is a front view of the embodiment of FIG. 1.
Figure 1B:
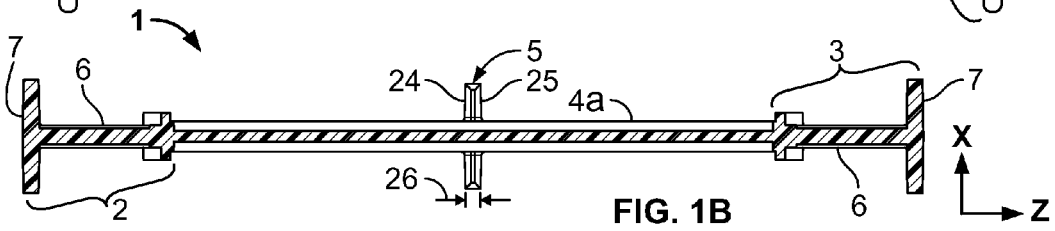
FIG. 1B is a bottom, cross sectional view of the embodiment of FIG. 1 taken along the line 1B shown in FIG. 1A.

Referring to FIGS. 1-1B, an embodiment of a form tie (1) for use with insulating concrete forms is shown. In an embodiment, a form tie (1) can include first and second spaced side members (2, 3), at least one cross member (4), and an interior fastening plate (5). A cross member (4) can also be referred to as a lateral member. In an embodiment, a form tie (1) can include an upper lateral member (4) and a lower lateral member (4*a*) positioned transverse the side members (2, 3) and connecting the side members (2, 3) such that the side members (2, 3) are maintained in a spaced relationship. In an embodiment, an upper lateral member (4) can include a first end (27) and a second end (28). The first upper lateral end (27) can be secured to the first side member (2). The second upper lateral end (28) can be secured to the second side member (3). Also, the upper lateral member (4) can extend between the first and second ends (27, 28), thereby spanning the lateral distance therebetween. Similarly, in an embodiment, a lower lateral member (4*a*) can include a first end (29) and a second end (30). The first lower lateral end (29) can be secured to the first side member (2). The second lower lateral end (30) can be secured to the second side member (3). Also, the lower lateral member (4*a*) can extend between the first and second ends (29, 30), thereby spanning the lateral distance therebetween. In an embodiment, each side member (2, 3) can be comprised of truss bracing (6) and an exterior fastening plate (7).

Figure 2:
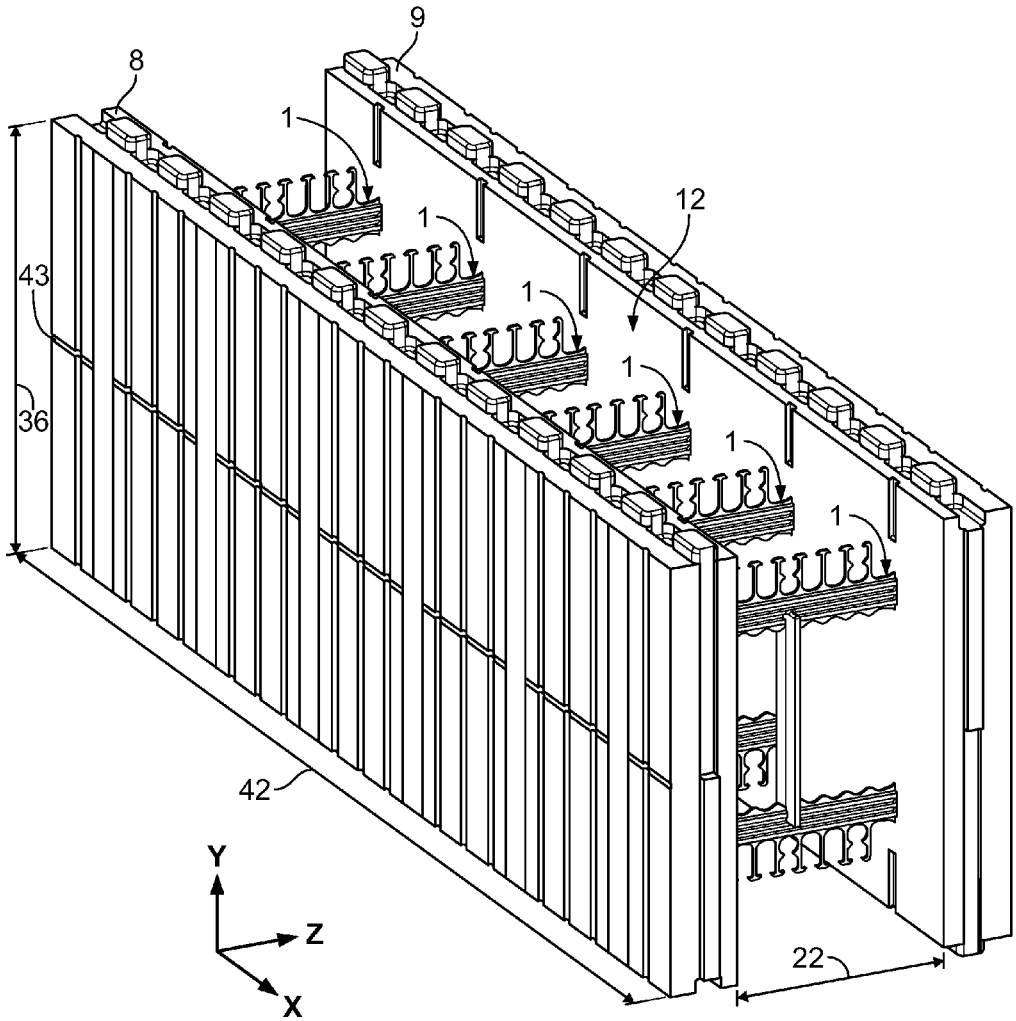
FIG. 2 is a top, left perspective view of an embodiment of an insulating concrete form having a plurality of interior fastening plates.
Figure 2A:
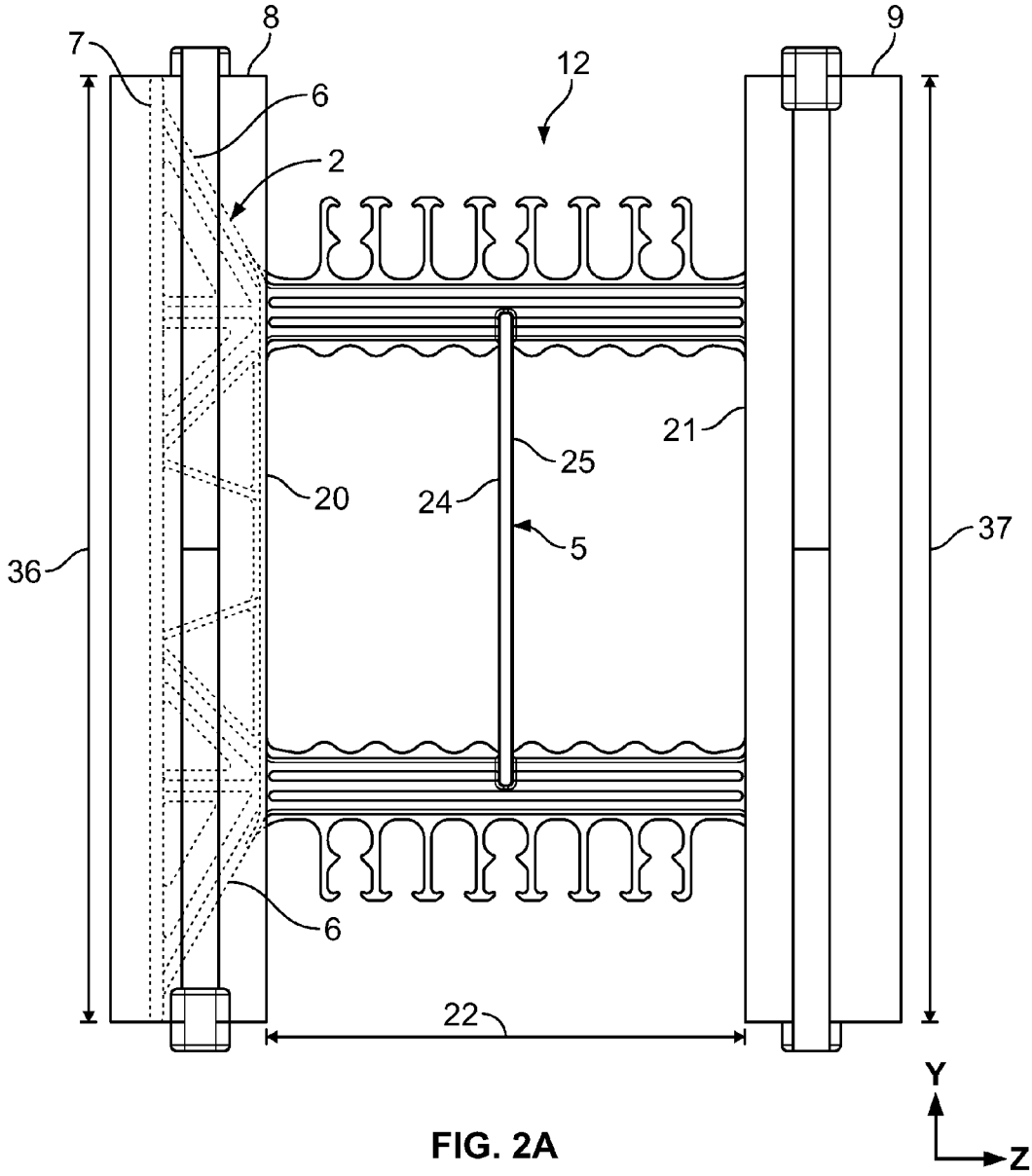
FIG. 2A is a front view of the embodiment of FIG. 2.

In an embodiment, insulating material, such as expanded polystyrene (EPS) foam, can be molded around the side members (2, 3) of a plurality of form ties (1) that include a plurality of fastening plates (5) to form sidewalls (8, 9) of an ICF, such as in the example shown in FIG. 2A. In an embodiment, a plurality of form ties (1) that include at least one interior fastening plate can include two or more form ties having an interior fastening plate. In an embodiment, a majority of the plurality of form ties (1) can include at least one fastening plate (5). FIG. 2A depicts in phantom format a side member (2) imbedded in a sidewall (8) of an ICF. Both the truss bracing (6) and the exterior fastening plate (7) can provide structure around which the EPS foam of the sidewall (8) can be molded and, thereby, secured to the form tie (1). The exterior fastening plate (7), which can also be referred to as a furring strip, also provides a backing surface to which fasteners for finishing surfaces, such as exterior siding or interior wall board, can be affixed. The truss bracing (6) further provides support for the exterior fastening plate (7). The sidewalls (8, 9) include first and second interior surfaces (20, 21) between which an interior cavity (12) for receiving poured concrete is defined. A thickness (22) of the interior cavity can be defined in a lateral direction (z) between the first and second interior surfaces (20, 21) of the first and second sidewalls (8, 9). Referring to FIG. 2A, an interior fastening plate (5) is shown within an interior cavity (12) of an insulated concrete form.

In an embodiment, the form tie (1) is made of plastic, such as polypropylene, and includes an interior fastening plate (5) of about 8 inches in height (y direction), about 1.40 inches in width (x direction), and about 0.20 inches in thickness (z direction). The term about as used herein in reference to dimensions means plus or minus 15% of the recited dimension. In an embodiment, the exterior fastening plates (7) can have the same width and thickness as the interior fastening plates (5). The form tie (1) and/or interior fastening plate (5) can also be made of other materials including metal, graphite, and composite materials.

In an embodiment, the interior fastening plate (5) can be positioned in between the spaced side members (2, 3). In an embodiment, an interior fastening plate (5) can include a first planar face (24) opposite a second planar face (25). Planar as used herein means a surface situated in a plane and includes, for example and without limitation, flat surfaces and generally flat surfaces that include minor deviations and/or imperfections in the surface. Such minor deviations and/or imperfections can be introduced to the surface as, for example, a design feature or the result and/or requirements of an injection molding process. The first planar face (24) can be substantially parallel to the second planar face (25). Substantially parallel as used herein means plus or minus about ten degrees from true parallel. A thickness (26) of the interior fastening plate (5) can be defined in a lateral direction (z) between the first planar face (24) and the second planar face (25). Similarly, the exterior fastening plates (7) can include planar faces that face in a lateral direction toward the exterior of the insulated concrete form. As shown by example in FIG. 2A, the planar faces (24, 25) of the interior fastening plate (5) can be oriented substantially parallel with the exterior planar faces of the exterior planar plates (7).

In an embodiment, an interior fastening plate (5) is secured from the upper and lower cross members (4, 4*a*), positioned at approximately the lateral center of the lateral members, and positioned substantially parallel to the exterior fastening plates (7) in vertical orientation. The lateral center can also be identified as a point about midway between the lateral member ends (27, 28 or 29, 30). In an embodiment, an upper plate portion (31) of an interior fastening plate (5) can be secured to an upper lateral member (4) of the form tie (1). Similarly, in an embodiment, a lower plate portion (32) of an interior fastening plate (5) can be secured to a lower lateral member (4*a*) of the form tie.

In an embodiment, the interior fastening plate (5) can be formed as a unitary molded component of the form tie (1) or as a separate component which is attachable to the form tie. An attachable interior fastening plate (5) can be attached to the form tie (1) using attachment structures know in the art, including but not limited to snap-on structure, fasteners, and/or adhesive. In an embodiment, the interior fastening plate can be secured directly to the side members and/or supported by a single lateral member and/or multiple lateral members forming trusses. In addition, the interior fastening plate can be positioned in various orientations, such as horizontally, and/or secured to adjacent form ties in an ICF. As depicted by example in FIGS. 2A and 3A, in an embodiment, an interior fastening plate (5) can be oriented such that a first planar face (24) of the interior fastening plate (5) faces in a lateral direction (z) toward the first interior surface (20) of the first sidewall (8) and a second planar face (25) of the interior fastening plate (5) faces in an opposite lateral direction (z) toward the second interior surface (21) of the second sidewall (9), the interior fastening plate (5) being spaced from the second interior surface (21) of the second sidewall (9).

Figure 3:
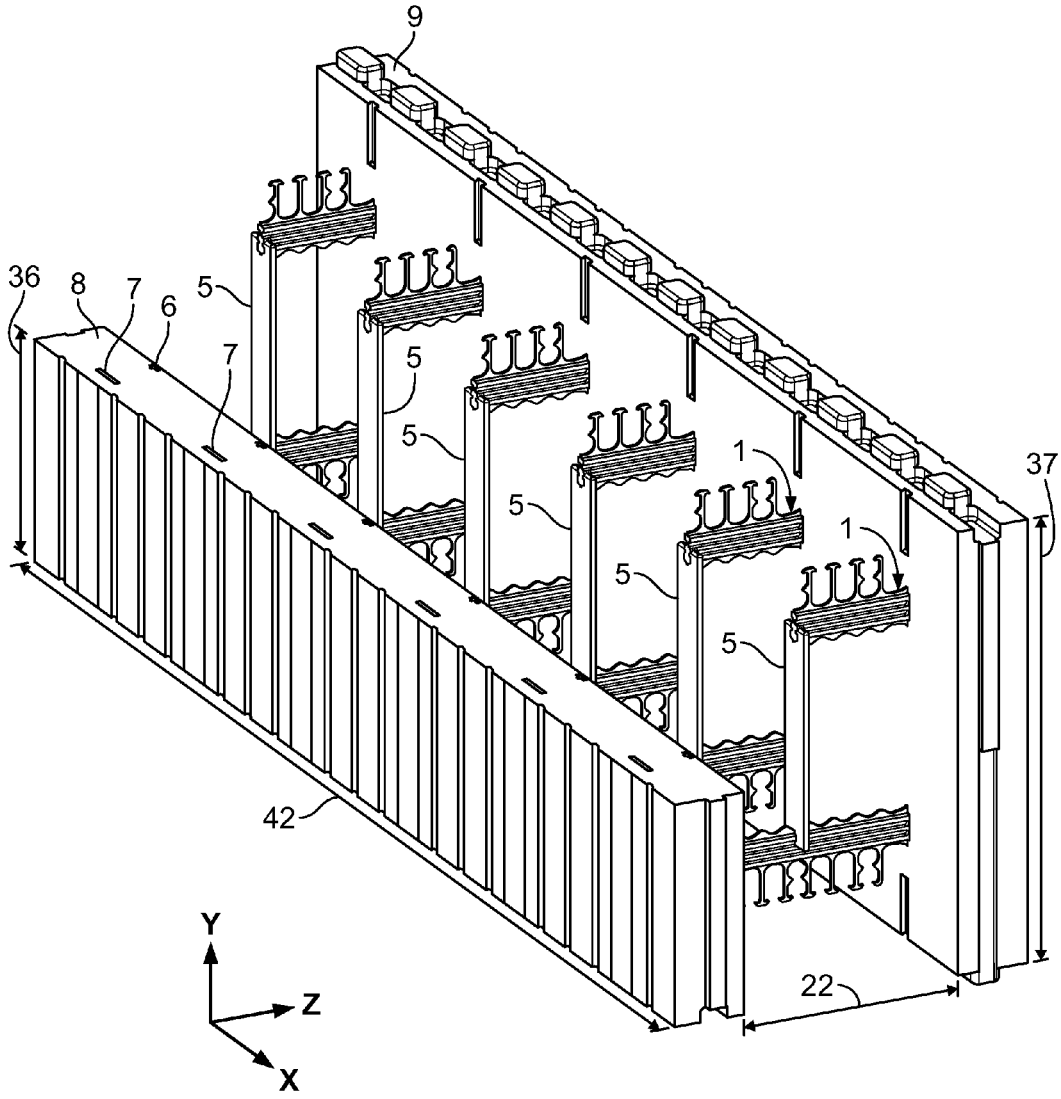
FIG. 3 is a top, left perspective view of an embodiment of an insulating concrete form having a plurality of interior fastening plates.
Figure 3A:
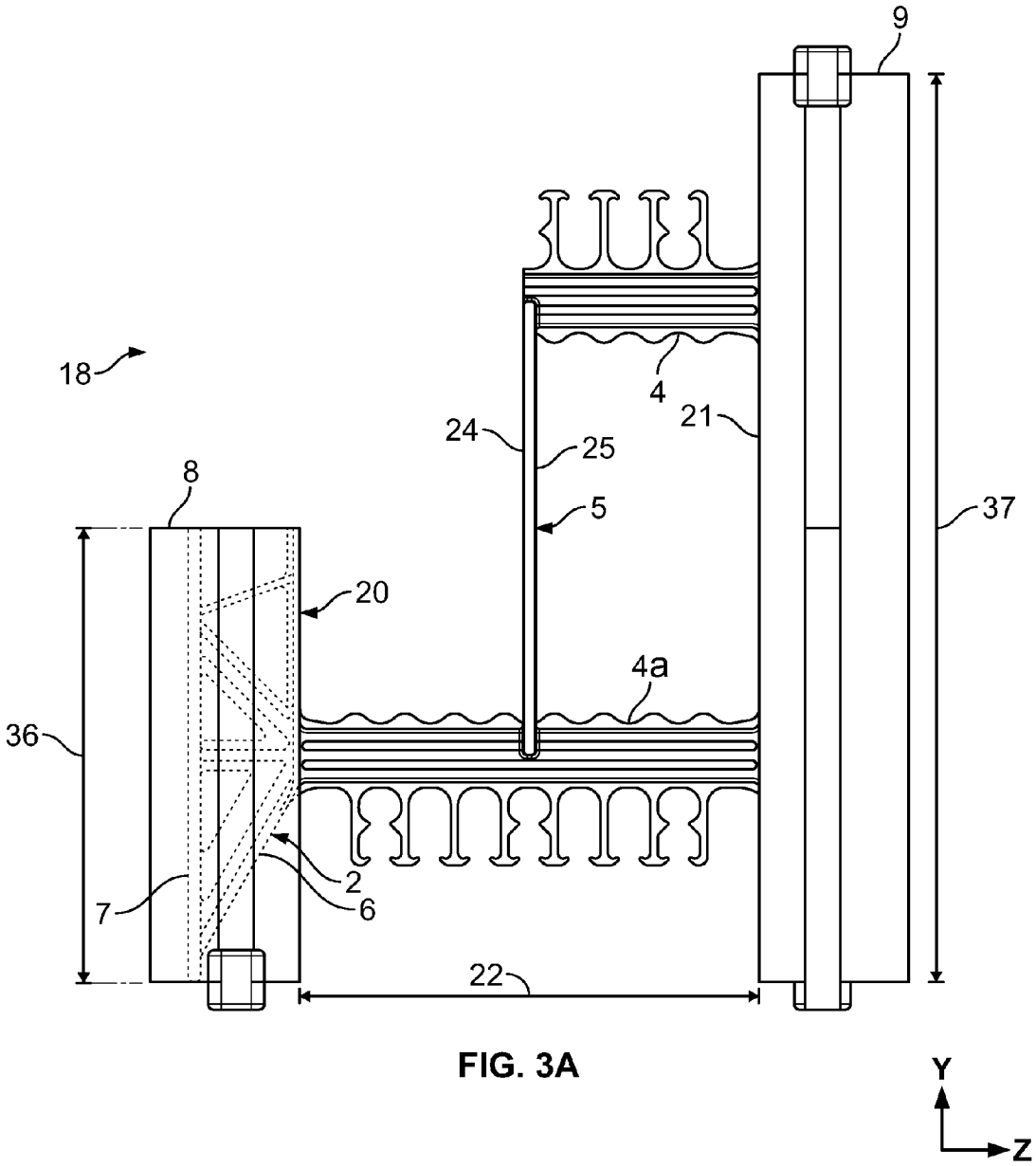
FIG. 3A is a front view of the embodiment of FIG. 3.

Referring to FIGS. 3-6, according to an embodiment, the interior fastening plate (5) provides a backing surface to which forming structures can be secured to create a form for making a recess (15) in the resulting concrete portion (16) of the wall (17). For example, in an embodiment, the sidewall (8) and form tie (1) of an ICF as shown in FIGS. 2 and 2A can be cut in a manner to allow the interior fastening plate (5) to be accessed from the side (18) of the ICF. Such cutting can result, for example, in a configuration as shown in FIGS. 3 and 3A, where a portion of the first sidewall (8) and upper lateral member (4) have been removed such that the first planar face (24) of the interior fastening plate (5) is easily accessible from a lateral direction (z), which can thereby facilitate the process of securing a forming structure (10) to the interior fastening plate (5). In an embodiment, such removal configures the first sidewall (8) so that the height (36) of the first sidewall (8) is less than the height (37) of the second sidewall (9). In an embodiment, the first sidewall (8) is cut along its entire length (42) (x direction) along a cut-line (43) positioned at the half-way point of the height (36) (y direction) of the sidewall, so that the height (36) of the first sidewall (8) is about half of the height (37) of the second sidewall (9). In an embodiment, less than the entire length (42) of the first sidewall (8) can be removed.

Figure 4:
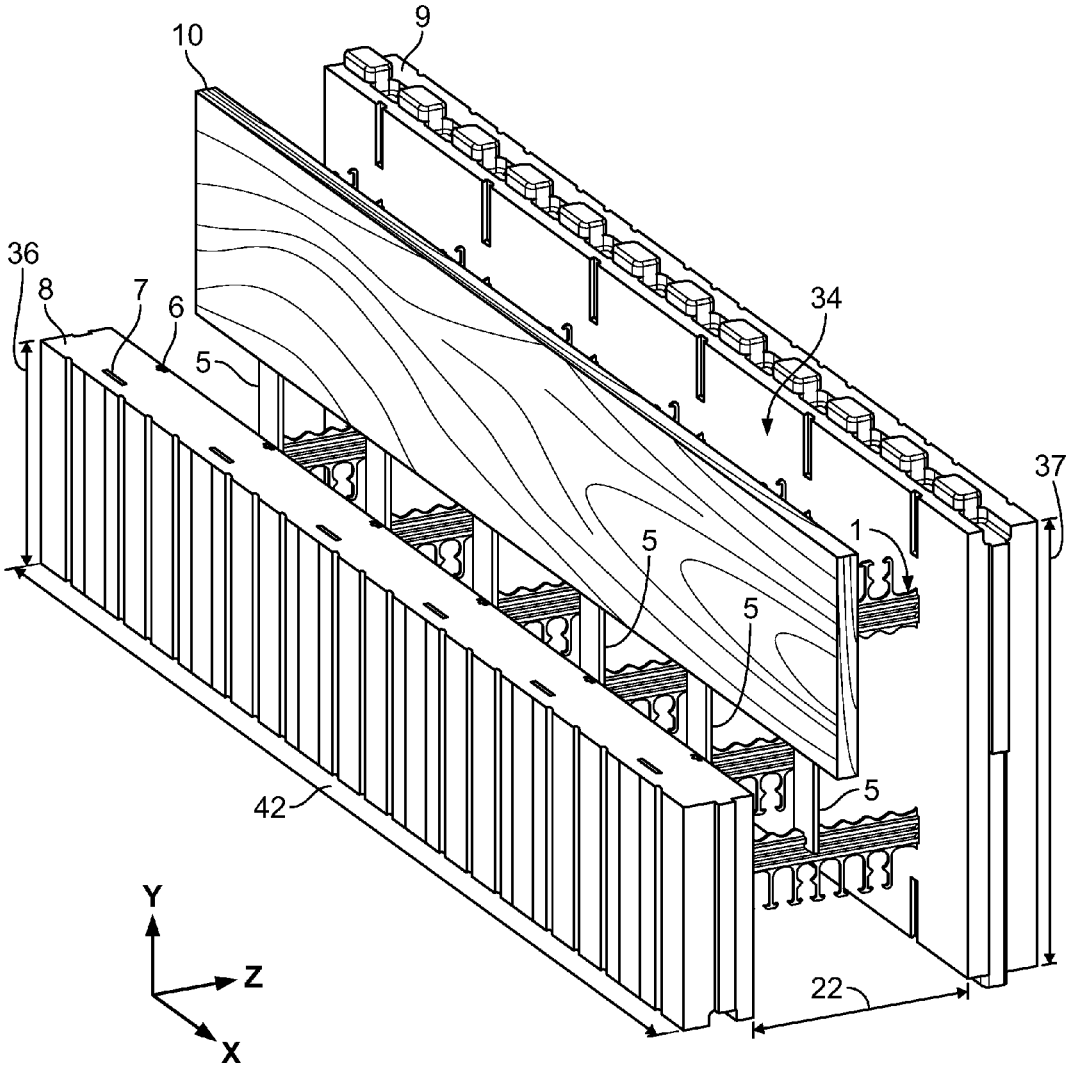
FIG. 4 is a top, left perspective view of an embodiment of an insulating concrete form having a forming structure secured to a plurality of interior fastening plates.
Figure 4A:
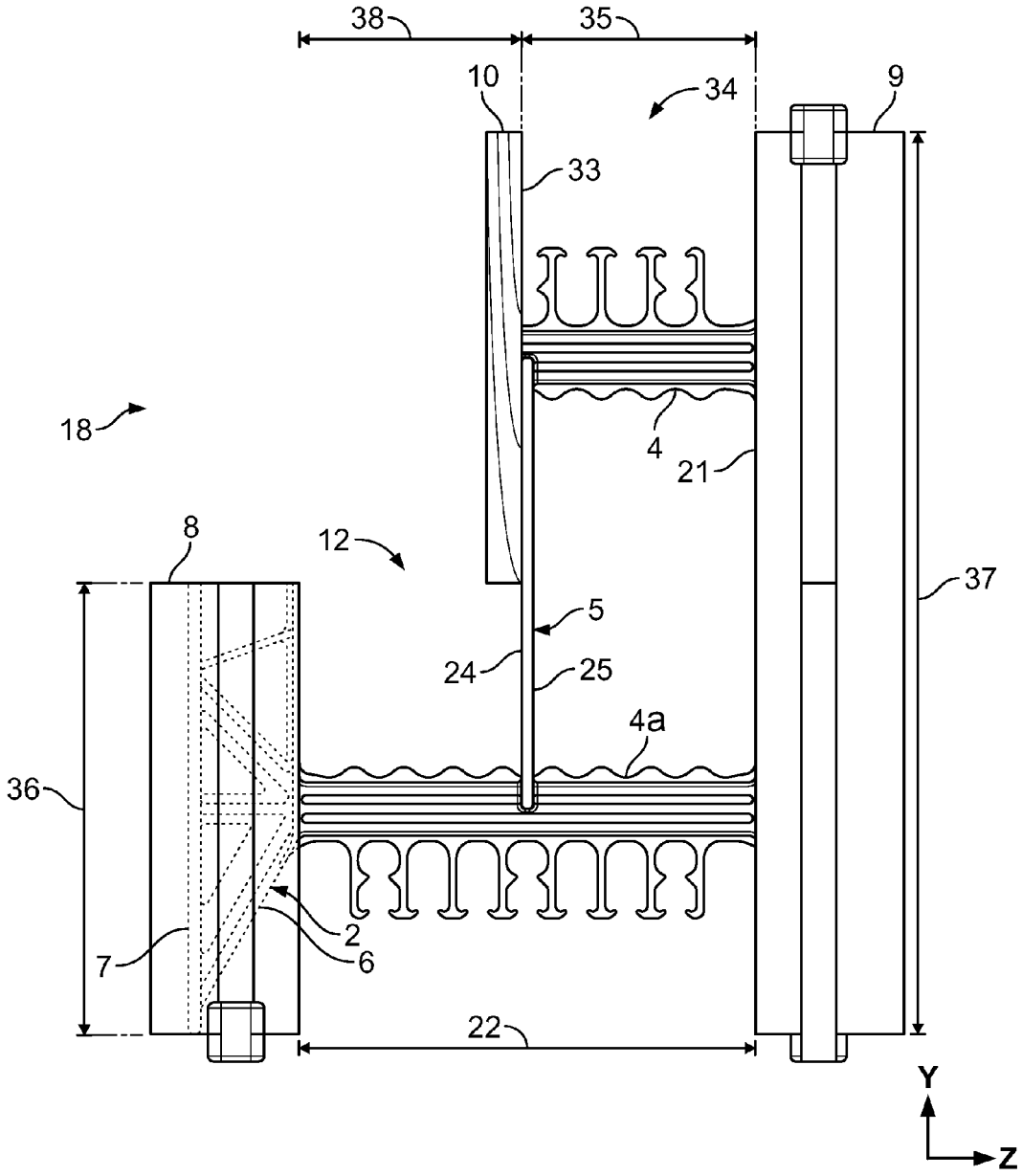
FIG. 4A is a front view of the embodiment of FIG. 4.
Figure 5:
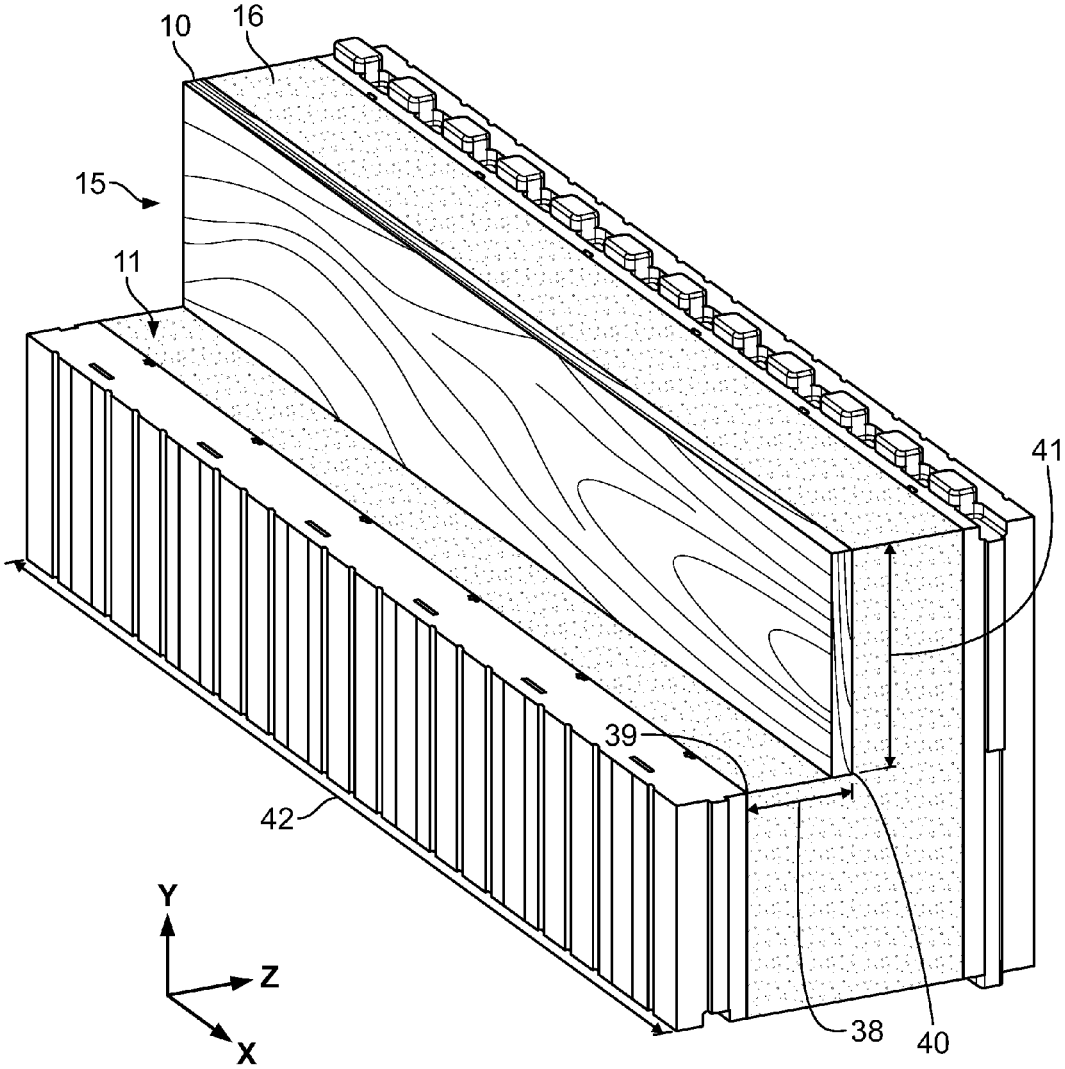
FIG. 5 is a top, left perspective view of the embodiment of FIG. 4 having concrete within the cavity of the form.
Figure 6:
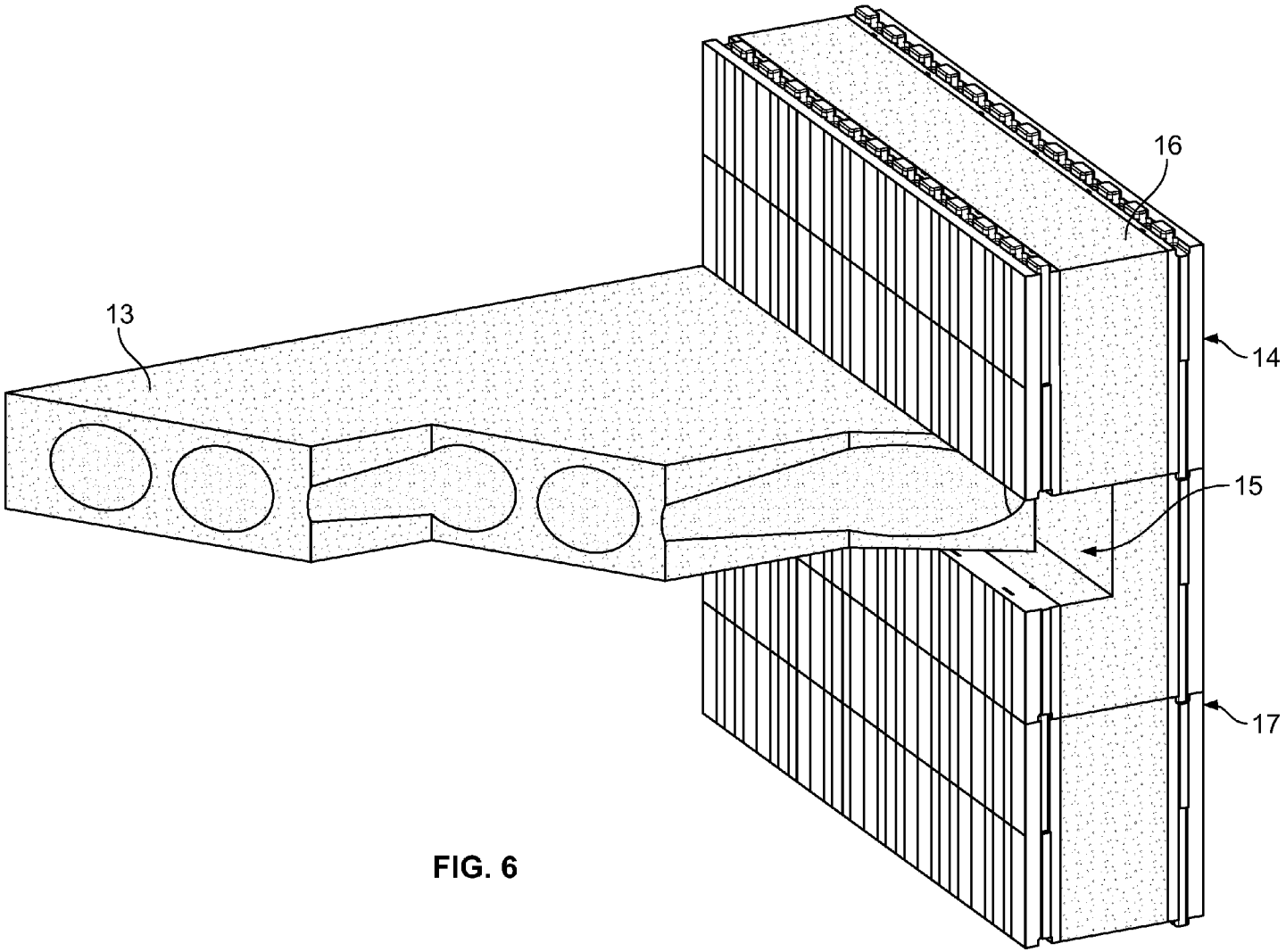
FIG. 6 is a top, left perspective view of a hollow-core concrete slab positioned in a recess defined in an embodiment of an insulating concrete form.

In an embodiment, an interior forming structure (10), such as a plywood board, can be secured to the interior fastening plates (5) as one aspect of creating a form to define a recessed portion (15) of the ICF—such as, for example, as shown in FIGS. 4-6. The interior forming structure (10) can be secured to the interior fasting plates (5) by fasteners known in the art, including without limitation snap on structure, screws, and adhesive. An interior forming structure (10) can include substantially planar interior forming surface (33). In an embodiment, the forming structure (10) is positioned against the first planar face (24) of the interior fastening plate (5) and secured to the interior fastening plate such that the interior forming surface (33) of the forming structure (10) faces toward the second interior surface (21) of the second sidewall (9). The interior forming surface (33) of the forming structure (10) is thereby spaced from the second interior surface (21) of the second sidewall (9) and defines a second interior cavity (34) in between the interior forming surface (33) and the second interior surface (21) of the second sidewall (9). A thickness (35) of the second interior cavity (34) can be defined in a lateral direction (z) between the interior forming surface (33) of the forming structure (10) and the second interior surface (21) of the second sidewall (9). In an embodiment, a recess (15) can be defined in a resulting concrete wall having the thickness (22) of the first interior cavity (12) being greater than the thickness (35) of the second interior cavity (34).

Figure 6A:
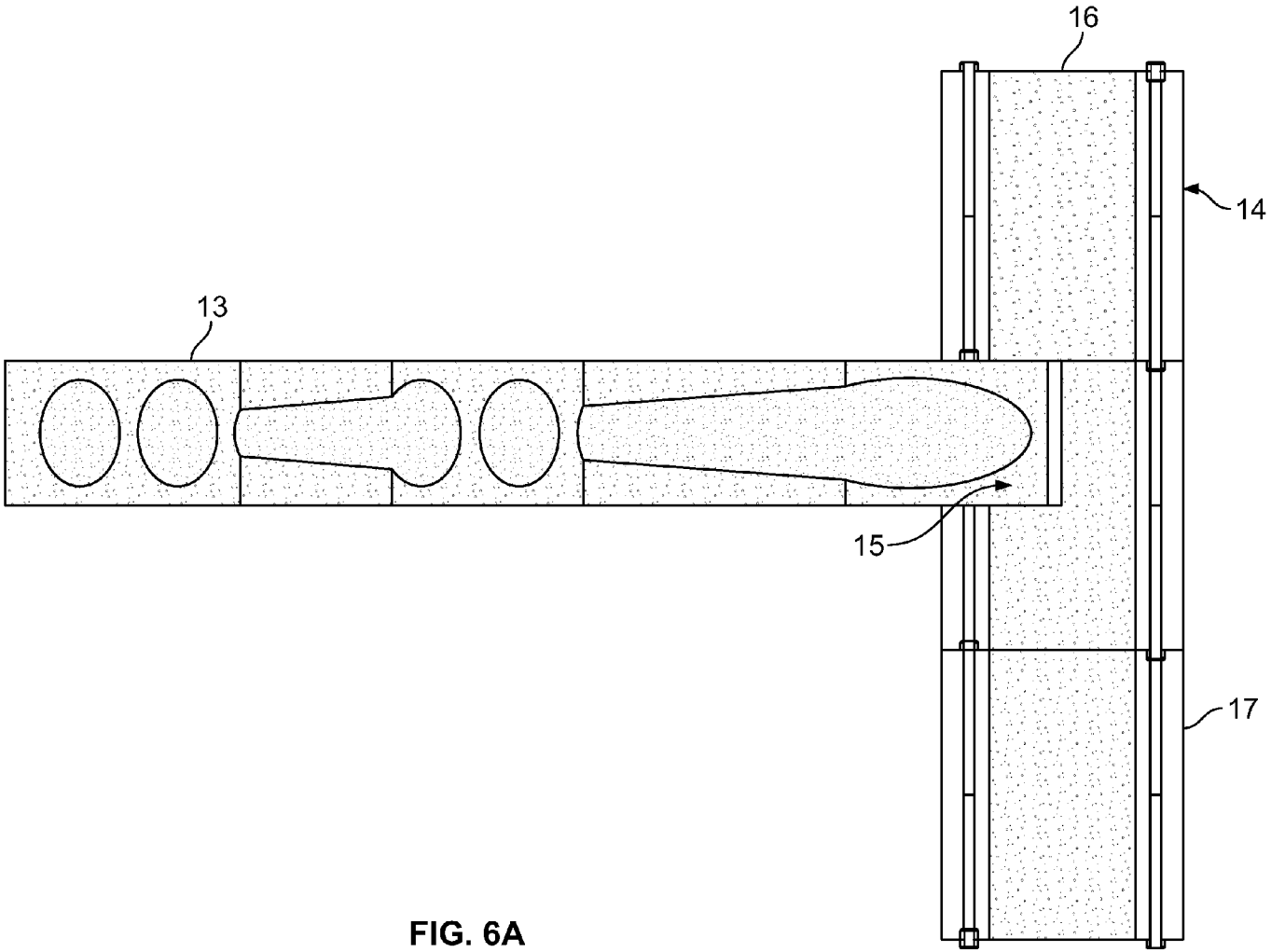
FIG. 6A is a front view of the embodiment of FIG. 6.

Additional forming structures can be secured in appropriate positions to further define the recess (15), such as positioning a board to define the bottom portion (11) of the recess or to cover any open sides of the ICF assembly, if necessary. Once the form defining the recess (15) is complete, liquid concrete can be poured into the cavity areas (12, 34) of the ICF assembly. Upon curing of the concrete, the forming structures (10) can be removed to reveal a recess defined in the concrete portion (16) of the wall (17), in which the thickness (35) of the concrete formed in the second interior cavity (34) is less than the thickness (22) formed in the first interior cavity (12). The form to define the recess (15) can be made according to various depths (38), lengths (42), and heights (41) to accommodate various structural elements (such as hollow-core concrete slabs, beams, trusses, and the like) and utilities (channels, conduits, piping, raceways, and the like). An example recess (15) formed to accommodate hollow-core concrete slab (13) is shown in FIGS. 6 and 6A. One example recess suitable for accommodating various types of hollow-core concrete slabs is about 3.5 inches in depth, as measured in lateral direction from the edge of the concrete portion where the recess begins (39) to where it ends (40), and about 8 inches in height (41). In an embodiment, the recess (15), and accordingly the first interior cavity (12) and the second interior cavity (34) can extend the entire length (42) of the ICF. In an embodiment, the recess can also extend over less than the entire length of the ICF.

According to one aspect of the invention, buildings of multiple stories can be constructed using ICF's with interior fastening plates (5) to form recesses as described above. For example, referring to FIGS. 6 and 6A, after a recess is formed and cast to accommodate a hollow-core concrete slab (13), additional courses (14) of ICF can be stacked and cast to form the subsequent story, including forming a recess on the top course of the subsequent story using ICF's with interior fastening plates as described above to accommodate a subsequent hollow-core concrete slab (not shown). This process can be repeated to form a multi-story structure.

The detailed drawings, specific examples and particular embodiments given serve the purpose of illustration only. While some of the specific embodiments of the systems and methods described and shown herein concern building a vertical wall utilizing insulated concrete forms, the teachings of the present invention may be applied to apparatuses that build other structures using insulated concrete forms. In the foregoing specification, the invention has been described with reference to specific examples of embodiments of the invention. It will, however, be evident that various modifications and changes may be made therein without departing from the broader spirit and scope of the invention. Furthermore, the interior fastening plate and recess may have any suitable size and shape. Furthermore, the interior fastening plate may be implemented in multiple configurations of ICF. In addition, other modifications, variations and alternatives to the interior fastening plate and methods of use are also possible. The specifications and drawings are, accordingly, to be regarded in an illustrative rather than in a restrictive sense. While certain embodiments detail certain optional features as further aspects of the invention, the description is meant to encompass and specifically disclose all combinations of these features unless specifically indicated otherwise or physically impossible.

The invention claimed is:

1. An assembly for construction of structures utilizing insulated concrete forms comprising:

an insulated concrete form comprising:

a first sidewall having a first interior surface, a second sidewall having a second interior surface, and wherein a height of the first sidewall is less than a height of the second sidewall;

a plurality of form ties, wherein the plurality of form ties connect the first sidewall to the second sidewall such that the first sidewall is spaced from the second sidewall to define a first interior cavity in between the first interior surface of the first sidewall and the second interior surface of the second sidewall, wherein a thickness of the first interior cavity is defined in a lateral direction between the first interior surface of the first sidewall and the second interior surface of the second sidewall;

the plurality of form ties comprising a first form tie, the first form tie having a first side member secured to the first sidewall, a second side member secured to the second sidewall, an upper lateral member, and a lower lateral member, wherein the upper and lower lateral members are positioned transverse the first and second side members, and wherein the lower lateral member connects the first side member to the second side member;

an interior fastening plate secured to the first form tie, the interior fastening plate having a first planar face, wherein the interior fastening plate is oriented such that the first planar face faces in a lateral direction toward the first interior surface of the first sidewall, and wherein the interior fastening plate is spaced from the second interior surface of the second sidewall;

a forming structure having an interior forming surface, the forming structure is secured to the interior fastening plate and oriented such that the interior forming surface of the forming structure faces toward the second interior surface of the second sidewall, and wherein the interior forming surface is spaced from the second sidewall to define a second interior cavity in between the interior forming surface of the forming structure and the second interior surface of the second sidewall, wherein a thickness of the second interior cavity is defined in a lateral direction between the interior forming surface of the forming structure and the second interior surface of the second sidewall; and wherein the thickness of the first interior cavity is greater than the thickness of the second interior cavity.

2. The assembly of claim 1 wherein the interior fastening plate is formed as a unitary molded component of the first form tie, the first form tie comprises a plastic material, and the first and second sidewalls of the insulated concrete form comprise an expanded polystyrene foam material.

3. The assembly of claim 2 wherein the interior fastening plate is about 8 inches in height, about 1.40 inches in width, and about 0.20 inches in thickness.

4. The assembly of claim 3 wherein the height of the first sidewall is about half the height of the second sidewall.

5. The assembly of claim 4 wherein the forming structure is secured to the interior fastening plate by at least one fastener.

6. The assembly of claim 5 wherein the upper lateral member comprises an upper lateral member end secured to the second side member;

wherein the lower lateral member comprises a first lower later member end secured to the first side member and a second lower lateral member end secured to the second side member;

wherein an upper plat portion of the interior fastening plate is secured to the upper lateral member; and wherein a lower plate portion of the interior fastening plate is secured to the lower lateral member at a point about midway between the first lower lateral member end and the second lower lateral member end.

7. The assembly of claim 5 wherein the first interior cavity and the second interior cavity extend along the entire length of the insulating concrete form.

8. The assembly of claim 1 wherein the insulating concrete form further comprises a plurality of interior fastening plates, wherein at least a majority of the plurality of form ties have at least one of the plurality of interior fastening plates secured thereon, and wherein the plurality of interior fastening plates are spaced from the second interior surface of the second sidewall and are positioned to face in a lateral direction toward the first interior surface of the first sidewall, and wherein the forming structure is secured to greater than one of the plurality of interior fastening plates.

9. A method for construction of structures utilizing insulated concrete forms comprising:

stacking a first insulating concrete form on a second insulating concrete form, wherein the first insulating concrete form comprises, a first sidewall having a first interior surface, a second sidewall having a second interior surface, and a plurality of form ties, wherein the plurality of form ties connect the first sidewall to the second sidewall such that the first sidewall is spaced from the second sidewall to define a first interior cavity in between the first interior surface of the first sidewall and the second interior surface of the second sidewall;

wherein the plurality of form ties comprise a first form tie, the first form tie having a first side member secured to the first sidewall, a second side member secured to the second sidewall, an upper lateral member, and a lower lateral member, wherein the upper and lower lateral members are positioned transverse the first and second side members, and wherein the lower lateral member connects the first side member to the second side member, and an interior fastening plate secured to the first form tie, the interior fastening plate having a first planar face, wherein the interior fastening plate is oriented such that the first planar face faces in a lateral direction toward the first interior surface of the first sidewall, and wherein the interior fastening plate is spaced from the second interior surface of the second sidewall;

removing a portion of the first sidewall such that the first planar face of the interior fastening plate is accessible from a lateral direction from a first side of the insulated concrete form;

securing a forming structure having an interior forming surface to the first planar face of the interior fastening plate such that the interior forming surface of the forming structure faces toward the second interior surface of the second sidewall and wherein the interior forming surface is spaced from the second sidewall to define a second interior cavity in between the interior forming surface of the forming structure and the second interior surface of the second sidewall, wherein a thickness of the second interior cavity is defined in a lateral direction between the interior forming surface of the forming structure and the second interior surface of the second sidewall, and wherein the thickness of the first interior cavity is greater than the thickness of the second interior cavity.

10. The method of claim 9 wherein the step of removing is performed by cutting the portion of the first sidewall and first side member.

11. The method of claim 9 further comprising pouring concrete into the first interior cavity and the second interior cavity and allowing the concrete to cure, wherein a concrete recess is defined in the first insulated concrete form.

12. The method of claim 11 positioning a first end of a building structural element into the concrete recess defined in the first insulated concrete form.

13. An insulated concrete form comprising:

a first insulated foam sidewall having generally vertical, height dimension section;

a second insulated sidewall spaced from the first insulated sidewall by a first distance to form a cavity between said first and second sidewalls for receipt of concrete, said second sidewall having a second generally vertical, height dimension section at least in part greater than said first sidewall height dimension section;

at least one connecting member for connecting the first sidewall to the second sidewall to maintain said first sidewall spaced from said second sidewall to thereby form said cavity between said first sidewall and said second sidewall, said connecting member including an intermediate concrete form member intermediate the first and second sidewalls, said intermediate concrete form member in combination with the first sidewall generally vertical, height section defining at least a portion of said cavity having a generally vertical dimension less than the second sidewall vertical, height dimension whereby said insulated concrete form in combination with concrete in said cavity includes at least a section having a generally vertical dimension less than another section vertical dimension.

* * * * *